US008602963B2

(12) United States Patent
Chilton, III

(10) Patent No.: US 8,602,963 B2
(45) Date of Patent: Dec. 10, 2013

(54) WARMING THERAPY DEVICE INCLUDING RETRACTABLE HOOD MEMBER

(75) Inventor: Robert J. Chilton, III, Quakertown, PA (US)

(73) Assignee: Draeger Medical Systems, Inc., Telford, PA (US)

( * ) Notice: Subject to any disclaimer, the term of this patent is extended or adjusted under 35 U.S.C. 154(b) by 716 days.

(21) Appl. No.: 12/738,800

(22) PCT Filed: Dec. 3, 2008

(86) PCT No.: PCT/US2008/085355

§ 371 (c)(1), (2), (4) Date: Apr. 19, 2010

(87) PCT Pub. No.: WO2009/073693

PCT Pub. Date: Jun. 11, 2009

(65) Prior Publication Data

US 2010/0249493 A1 Sep. 30, 2010

Related U.S. Application Data

(60) Provisional application No. 61/005,356, filed on Dec. 4, 2007.

(51) Int. Cl.
*A61G 11/00* (2006.01)

(52) U.S. Cl.
USPC ..... 600/22

(58) Field of Classification Search
USPC ..... 600/21, 22; 128/205.26
See application file for complete search history.

(56) References Cited

U.S. PATENT DOCUMENTS

| | | | | |
|---|---|---|---|---|
| 4,334,629 | A | 6/1982 | Koch et al. | |
| 4,936,824 | A | 6/1990 | Koch et al. | |
| 5,649,896 | A | 7/1997 | Barsky | |
| 6,234,954 | B1 | 5/2001 | Mackin | |
| 6,893,390 | B1 | 5/2005 | Mackin | |
| 2006/0226742 | A1 | 10/2006 | Gevaert | 312/72 |

FOREIGN PATENT DOCUMENTS

| | | | |
|---|---|---|---|
| EP | 0032133 | 7/1981 | |
| EP | 0 291 280 | 11/1988 | A61G 11/00 |
| EP | 1 525 869 | 4/2005 | A61G 11/00 |
| EP | 1543808 | 6/2005 | |
| GB | 2389535 | 12/2003 | |
| JP | 59-17310 | 1/1984 | |
| JP | 61-38700 | 8/1986 | |
| JP | 64-5549 | 1/1989 | |
| JP | 08 140813 | 6/1996 | A47G 25/00 |
| JP | 2005-177480 | 7/2005 | |

OTHER PUBLICATIONS

Corresponding European Communication dated Jan. 28, 2013.
Corresponding European Communication with Search Report dated Dec. 7, 2012.
Corresponding Japanese Office Action dated May 15, 2012 and English translation thereof.

*Primary Examiner* — Christine Matthews
(74) *Attorney, Agent, or Firm* — DLA Piper LLP (US)

(57) ABSTRACT

An apparatus and method for providing patient access in a warming therapy device (e.g., incubator, warmer, etc.) is described. In one exemplary embodiment, the apparatus comprises a hood with a retractable top member, which permits access to a patient disposed within the warming therapy device without lowering or removal of one or more sidewalls of the hood.

15 Claims, 19 Drawing Sheets

WARMING THERAPY DEVICE INCLUDING RETRACTABLE HOOD MEMBER

CROSS REFERENCE TO RELATED APPLICATIONS

This application is a §371 of International Application No. PCT/US08/85355, filed Dec. 3, 2008 (WO 2009/073693, published Jun. 11, 2009), which claims priority to U.S. Provisional Patent Application No. 61/005,356, filed Dec. 4, 2007, the entire contents of which are incorporated herein by reference, as if fully set forth herein.

TECHNICAL FIELD

The present invention relates generally to a method and apparatus for providing patient access in a warming therapy device (e.g., incubator, warmer, etc.). More particularly, the present invention relates to a method and apparatus for accessing an infant patient disposed in a warming therapy device by means of a retractable hood member.

BACKGROUND

Conventional warming therapy devices typically include a platform and a one-piece hood component for covering the platform in a manner that creates is controlled environment, such as an incubation chamber. A patient receiving treatment via as warming therapy device may be positioned onto the platform and then covered via the hood component. In order to access the patient, a caretaker must typically remove the entire hood component, thereby exposing the patient to the ambient surroundings. Further, once the hood component is removed, there is nothing preventing the patient from rolling off of the platform and becoming injured.

In order to address these deficiencies, certain hood components have been configured with openings in their lateral walls, thereby enabling a caretaker to reach through the openings and access the patient without having to remove the entire hood component. Although such configurations do improve upon the conventional design, access to the patient is still very limited, and full access to the patient (e.g., for removing the patient from the platform) may still only be achieved via removing the entire hood component.

Accordingly, it would be desirable to an incubation device and a hood assembly that provides a safe incubation environment, while at the same time providing unencumbered access to a patient in a manner that does not require removal of the entire hood assembly.

SUMMARY

An exemplary embodiment of the present invention comprises a support platform and a hood assembly comprising a retractable top portion, one or more adjustable sidewalls, and means for positioning the top portion relative to the support platform.

A further exemplary embodiment provides a hood assembly having a retractable top portion and one or more adjustable sidewalls. The hood assembly also has a means for positioning the retractable top portion relative to the hood assembly and a means for adjusting one or more of the sidewalls.

A still further exemplary embodiment includes a mobile warming therapy device for infant patients having a retractable top portion. The warming therapy device also includes a transportation assembly and a patient support platform coupled to the transportation assembly for supporting a patient. The warming therapy device also includes a heating unit for radiating heat onto the patient support platform and a hood assembly for covering the patient residing on the patient support platform.

DETAILED DESCRIPTION

The present invention relates to a warming therapy device (e.g., incubator, radiant warmer, etc.) including a hood assembly that comprises a retractable top portion and one or more adjustable sidewalls.

Figure 1:
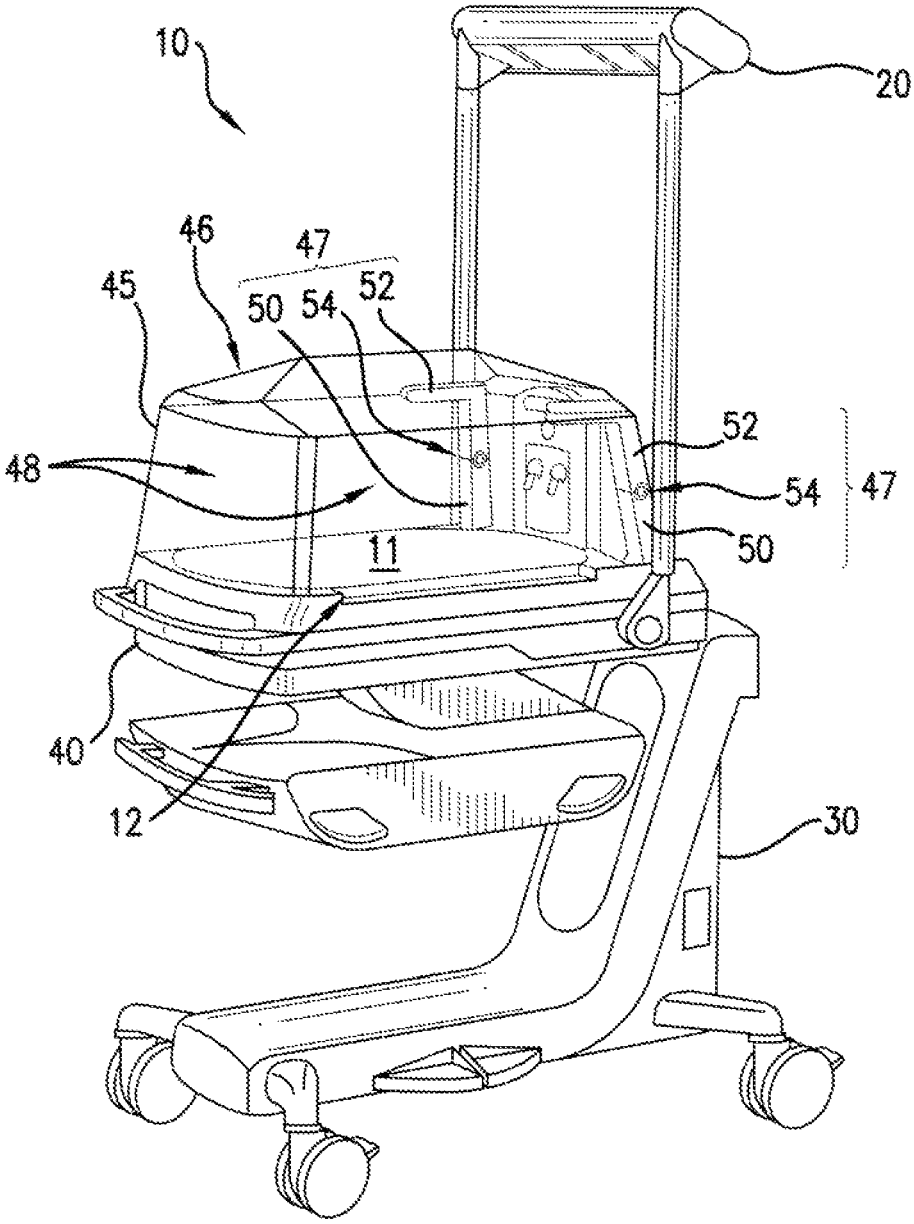
FIG. 1 is perspective view of a first exemplary embodiment of a warming therapy device.
Figure 2:
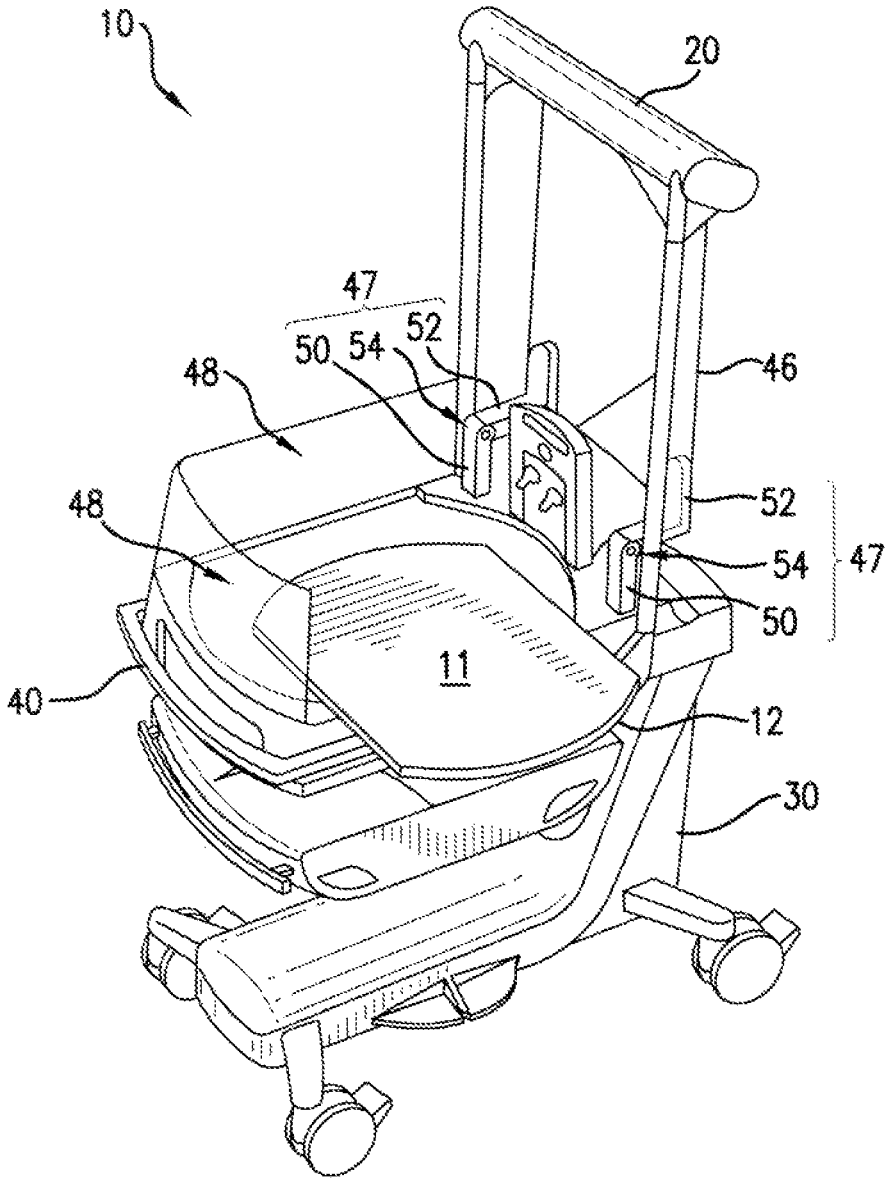
FIG. 2 is an overhead perspective view of the warming therapy device of FIG. 1, shown in a partially open configuration.

FIGS. 1 and 2 show a first exemplary embodiment of a warming therapy device 10. The warming therapy device 10 includes a radiant heater 20, a transportation assembly 30, a patient support platform 40, and a hood assembly 45. The radiant heater 20 may comprise any radiant heat source known in the art, such as infrared, for emanating heat (preferably in a regulated manner) onto a patient residing on the patient support platform 40. The transportation assembly 30 provides additional support and mobility to the warming therapy device 10, and may include connections to other treatment devices (not shown). The patient support platform 40 is configured for supporting a patient, typically an infant, which may be receiving warming therapy. The patient support platform 40 has a mattress tray 12 with a mattress 11 disposed thereon.

The hood assembly 45 may have a retractable top portion 46 and one or more adjustable sidewalls 48. As shown, the top portion 46 is adapted to pivot about one or more hinged members 47. The hinged member 47 has a first member 50 connected to the patient support platform 40 and a second member 52 connected to the top portion 46. The first and second members 50, 52 are connected by a hinge 54, such as a pin, piano hinge or some other member that allows the second member 52 to rotate about a single axis with respect to the first member 50.

As seen in FIGS. 1 and 2, the hinge 54 is preferably spaced between the top of the patient support platform 40 and the bottom surface of the top portion 46. Alternatively, the hinge 54 may be located adjacent the patient support platform 40, or adjacent the top portion 46. Depending on the location of the hinge 54, the length of the first and second members 50, 52 will vary. Depending on the configuration of the warming therapy device 10, it may be desirable to move the hinge 54 closer to either of the top portion 46 or the partial support platform 40. For example, in a configuration where the radiant heater 20 is spaced back away from the patient support platform 40, or if the height of the radiant heater 20 is not great, it may be desirable to have the hinge 54 placed closer to the patient support platform 40, such that the height of the top portion 46 in the open position is minimized and so that the top portion 46 does not obstruct the path between the radiant heater 20 and the patient support platform 40 because the top member 46 is spaced away from the patient support platform 40 in the open position. This spacing is due to the second member 52 being longer than the first member 50 when the hinge 54 is close to the patient support platform 40. Conversely, if lateral space is an issue or if the radiant heater 20 is positioned away from the hinged member 47, it may be desirable to position the hinge 54 closer to the top portion 46, such that the first member 50 is longer than the second member 52 and the top portion 46 is not spaced from the patient support platform 40 when in the open position.

As a result of utilizing the hinged member(s) 47, the top portion 46 may be positioned into any one of a first, open position (as shown in FIG. 2), a second, closed position (as shown in FIG. 1), or in any suitable position therebetween. As will be appreciated by those of ordinary skill in the art, the ability to retract the top portion 46 of the hood assembly 45 (without having to disturb any of the sidewall(s) 48) vastly improves the access a caretaker may have to a patient residing on the support platform 40. Patient safety and comfort is also maintained by way of being able to keep one or more of the side walls 48 in a raised position when the top portion 46 is opened.

The hood assembly 45 may also have one or more sidewalls 48 configured for independent adjustment relative to the patient support platform 40. The means for adjusting these sidewalls 48 may include one or more of a sliding mechanism (e.g., a guide channel and complementary protrusion) for raising and lowering the sidewall(s) 48, a pivoting mechanism (e.g., a hinged member) for pivoting the sidewall(s) 48 into position, a rotating mechanism (e.g., a rotating member) for rotating the sidewall(s) 40 into position, a linkage, such as a four bar linkage and/or any other mechanism for moving/adjusting the sidewall(s) 48 into a desired position.

In one exemplary embodiment, one or more of the sidewalls 48 may comprise a sliding mechanism (not shown) for positioning said sidewall(s) 48. This sliding mechanism may include one or more guide members coupled to at least one of the sidewalls 48 and/or to the support platform 40. Preferably, the guide member includes a guide channel and an opening at one end. In addition, one or more protrusion members, each having a protrusion extending therefrom, may be provided for engaging at corresponding guide channel through the guide channel opening. These protrusion members may be coupled to the patient support platform 40 and/or to a sidewall 48, with the guide channel on the opposite structure.

Using the aforementioned sliding mechanism, a sidewall 48 may be raised or lowered into a desired position by sliding a protrusion member (coupled to the sidewall 48, for example) within a corresponding guide member (coupled to the support platform 40 or to another sidewall 48). Alternatively, the guide channel may be coupled to the sidewall 48, and the protrusion member may be coupled to the support platform 40 (or to another sidewall 48). By including one or more of these sliding mechanisms, the sidewall(s) 48 (whether collectively or individually) may be guided into any one of a first position (such as an open position as shown in FIG. 2), a second position (such as a closed position as shown in FIG. 1), or as third position between said first and second positions.

In another exemplary embodiment, one or more of the sidewalls 48 may include a pivoting mechanism for positioning said sidewall(s) 48. This pivoting mechanism may comprise one or more hinged members (not shown) coupled at one end to a sidewall 48 and at an opposite end to the patient support platform 40 (or to another sidewall 48), thereby pivotally affixing the sidewall 48 to the patient support platform 40. In use, a sidewall 48 coupled via a hinged member may be pivoted into any one of a first position (such as an open position as shown in FIG. 2), a second position (such as a closed position as shown in FIG. 1), or a third position between said first and second positions.

In yet another exemplary embodiment, one or more of the sidewalls 48 may comprise a rotating mechanism for positioning said sidewall(s) 48. This rotating mechanism may comprise a rotating member having a first end coupled to a sidewall 48, such as at a lower outside corner of the sidewall, and a second end coupled to the patient support platform 40 (or to another sidewall 48), thereby rotatably affixing the sidewall 48 to the support platform 40 (or to another sidewall 48). In use, the sidewall coupled to the patient support platform 40 via the rotating member may be rotated into any one of a first position (such as an open position as shown in FIG. 2), a second position (such as a closed position as shown in FIG. 1), or as third position between said first and second positions.

Optionally, the hood assembly 45 may also include one or more stop mechanisms (not shown) or temporarily locking the top portion 46 and/or one or more of the sidewalls 48 in a desired position. Each of these stop mechanisms may be a part of the positioning mechanisms used in respect of the top portion 46 and/or the sidewalls 48 (e.g., hinged member, sliding mechanism, etc.), or they may be independent components. One or more release mechanisms (not shown) may also be included to enable the top portion 46 and/or any of the sidewalls 48 to be completely removed from hood assembly 45.

FIG. 2 shows the warming therapy device 10 having the top portion 46 of the hood assembly 45 in a first, open position. In the opened position, the top portion is rotated, approximately ninety degrees (90°) away from the patient support platform 40 using the hinged members 47. As noted above, the top portion 46 may be positioned at any angle between closed and open, and held in that position via an optional stop mechanism. Further, in some configurations, the range of motion of the top member 46 ma be greater or less than 90°. The portion 46 may be positioned using one or more hinged members 47, as shown, and/or one or more sliding mechanisms (which are further discussed below).

Also shown in FIG. 2 is one of the sidewalls 48 positioned in a first, open position. In this figure, the opened sidewall 48 may be adjusted using a sliding mechanism, for example, to position it beneath the plane of the patient support platform 40. As a result, a patient residing on the support platform 40 may easily be accessed from the top or side of the warming therapy device 10.

Referring now to FIGS. 3-9, a warming therapy device 100 is shown according to a second exemplary embodiment of the present invention. Each of FIGS. 3-9 further shows the various components of the warming therapy device 100 in various positions.

The warming therapy device 100 includes a radiant heater 120, a transportation assembly 130, a patient support platform 140, and a hood assembly 145. The radiant heater 120 may comprise any radiant heat source known in the art for emanating regulated heat onto a patient residing on the patient support platform 140. The transportation assembly 130 provides additional support and mobility to the warming therapy device 100, and may include connections to other treatment devices (not shown). The patient support platform 140 may be configured for supporting an infant patient receiving treatment, and it may include a mattress tray 112 with a mattress 111 disposed thereon.

The exemplary hood assembly 145 may comprise a retractable top portion 146 and one or more adjustable sidewalls 148, including a front sidewall 148', two lateral sidewalls 148", and a rear sidewall 148'''. It should be understood that the hood assembly 145 may include more or fewer sidewalls 148 as dictated by the needs of the particular implementation. Further, each sidewall 148 (whether front, lateral, or rear) may itself be divided into one or more segments, thereby allowing for partial access to the interior of the patient support platform 140. As shown, the rear sidewall 148''' includes two panels separated by a rigid member 150 for providing added support and connections to external devices.

The top portion 146 of the hood assembly 145 is coupled to the rear sidewall 148''' via a hinged member 147 for pivoting the top portion 146 opened and closed (see FIG. 4), and via a sliding mechanism for retracting and further positioning the top portion 146. The sliding mechanism shown comprises one or more protrusion members 151 and one or more corresponding guide members 152. The one or more guide members 152 preferably define a track or guide channel, and an opening at one end. These guide members 152 may be coupled to the rear sidewall 148''' rigid member, as shown, or to the patient support platform 140 (or in some cases, to the top portion 146 or sidewall 148). Complementing the guide member(s) 152 are one or more protrusion members 151, each having a protrusion extending therefrom, for engaging a corresponding guide member 152. The protrusion members 151 may be coupled to the top portion 146, to a sidewall 148, and/or to the patient support platform 140 (depending on the location of the guide members 152).

The rigid member 150 is configured in a generally vertical orientation and located along the centerline of the patient support platform 140 adjacent the rear sidewall 148'''. A portion of the rigid member 150 extends outwardly from the outer surface of the rear sidewall 148''' and contains guide members 152. The guide members 152 may be tracks or rails and adapted to engage mating protrusion members 151, which are connected to the top portion 146. The protrusion members 151 support the top portion 146 and is adjustable along the guide member of the rigid member 150. The top portion 146 may be hingedly connected to the protrusion portion 151 or may be fixed to the to portion 146. In an embodiment where the top portion 146 is fixed to the protrusion member 151, the guide member 152 may be curved or the protrusion member 151 may pivot with respect to, along with sliding within, the guide member 152 to facilitate the portion 146 moving to a substantially vertical position as the top portion 146 is opened (i.e. by sliding the protrusion member 151 along the guide member 152).

Figure 5:
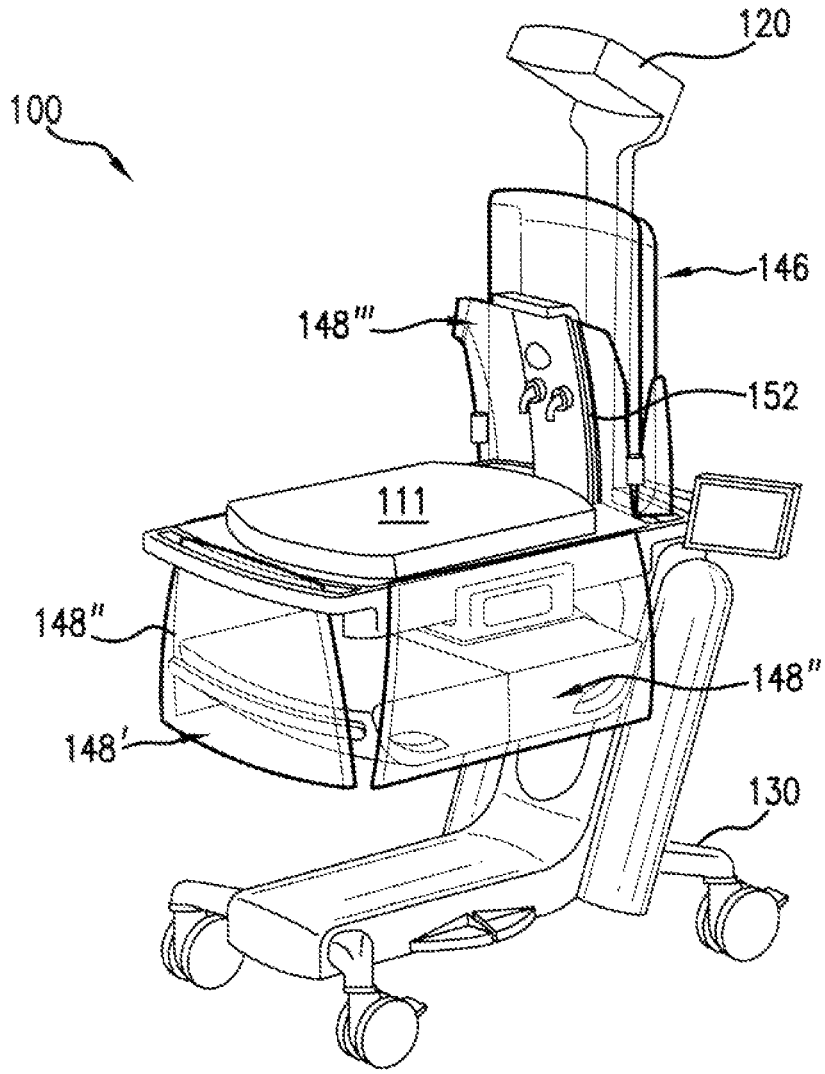
FIG. 5 is a perspective view of the warming therapy device of FIG. 3, shown in a partially open configuration.
Figure 6:
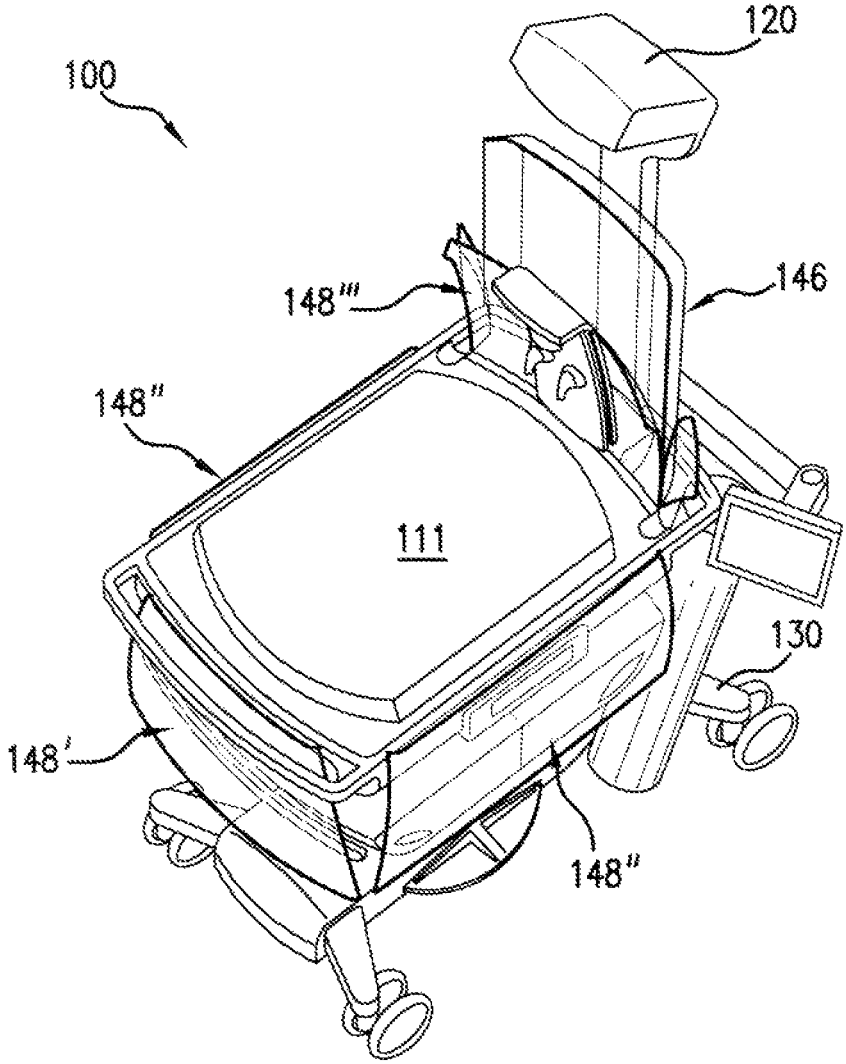
FIG. 6 is an overhead perspective view of the warming therapy device shown in FIG. 5.
Figure 7:
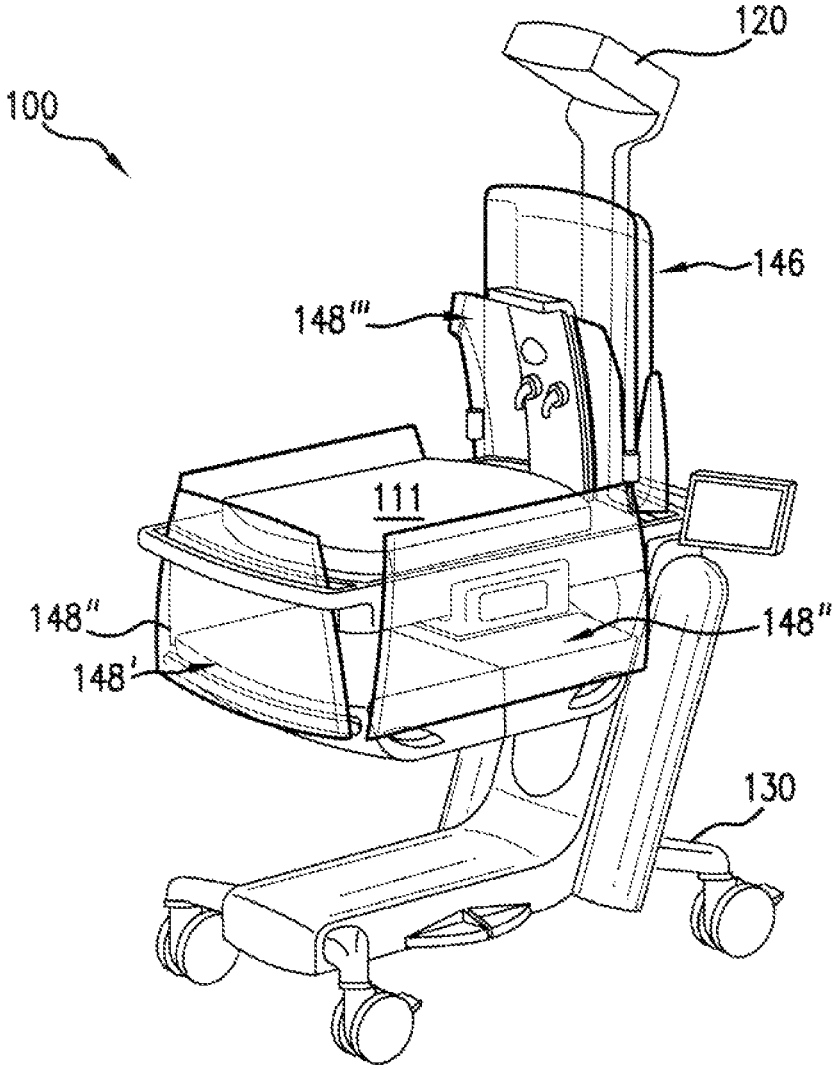
FIG. 7 is a perspective view of the warming therapy device of FIG. 3, shown in a partially open configuration.

The top portion 146 may be retracted and positioned by engaging one or more protrusion members 151 into one or more corresponding guide members 152 and then sliding the protrusion member(s) 151 along the guide members 152 guide channel(s). Thus, the top portion 146 may be retracted from a closed, or second, position (a shown FIG. 3) to an open, or first, position (as shown in FIGS. 5-7), or to a third position between the first and second positions, by simply sliding the protrusion member(s) 151 along the guide member(s) 152 until a desired position is reached.

The hood assembly 145 may also have one or more sidewalls 148, each configured for independent adjustment relative to the patient support platform 140. The means for adjusting these sidewalls 148 may include one or more of a sliding mechanism (e.g., comprising a guide channel and complementary protrusion), a pivoting mechanism (e.g., a hinged member), a rotating mechanism (e.g., a rotating member), a linkage, such as a four bar linkage, and/or any other mechanism for moving/adjusting the sidewall(s) 148 into a desired position.

A sliding mechanism (not shown) for adjusting the sidewalls 148 may include one or more guide members, each defining a guide channel and an opening at one end, coupled to at least one of the sidewalls 148 and/or to the support platform 140. In addition, one or more protrusion members, each having a protrusion extending therefrom, may be provided for engaging the guide channel through the guide channel opening. These protrusion members may be coupled to the patient support platform 140 and/or to a sidewall 148. In use, a sidewall 148 may be positioned by engaging a protrusion member (coupled to the sidewall 148, for example) into a corresponding guide member (coupled to the support platform 140 or to another sidewall 148, for example) and then sliding the protrusion member up or down along the guide member's guide channel until a desired position is reached.

In another exemplary embodiment, one or more of the sidewalls 148 may comprise a pivoting mechanism, which, as discussed above, may include one or more hinged members coupled at one end to a sidewall 148 and at an opposite end to the patient support platform 140 (or to another sidewall 148). In use, a sidewall 148 coupled via a hinged member may be pivoted into any one of a first, open position (as seen in FIG. 5), a second, closed position (as seen in FIG. 3), or any position therebetween, by simply actuating the hinged member(s).

In yet another exemplary embodiment, one or more of the sidewalls 148 may comprise a rotating mechanism. This rotating mechanism may comprise a rotating member have a first end coupled to a sidewall 148 and a second end coupled to the patient support platform 140 (or to another sidewall 148). In use, the sidewall 148 coupled via the rotating member may be rotated into any one of a first, open position, a second, closed position, and a third position between the first and second positions.

Optionally, the hood assembly 145 described above may also include one or more stop mechanisms (not shown) for temporarily locking the top portion 146 and/or one or more of the sidewalls 148 in a desired position. Each of these stop mechanisms may be a part of the mechanisms used positioning the top portion 146 and/or sidewalls 148 (e.g., hinged member, sliding mechanism, etc.), or they may comprise independent components, such as latches. One or more release mechanisms may also be included to enable the top portion 146 and/or any of the sidewalls 148 to be completely removed front hood assembly 145.

Figure 3:
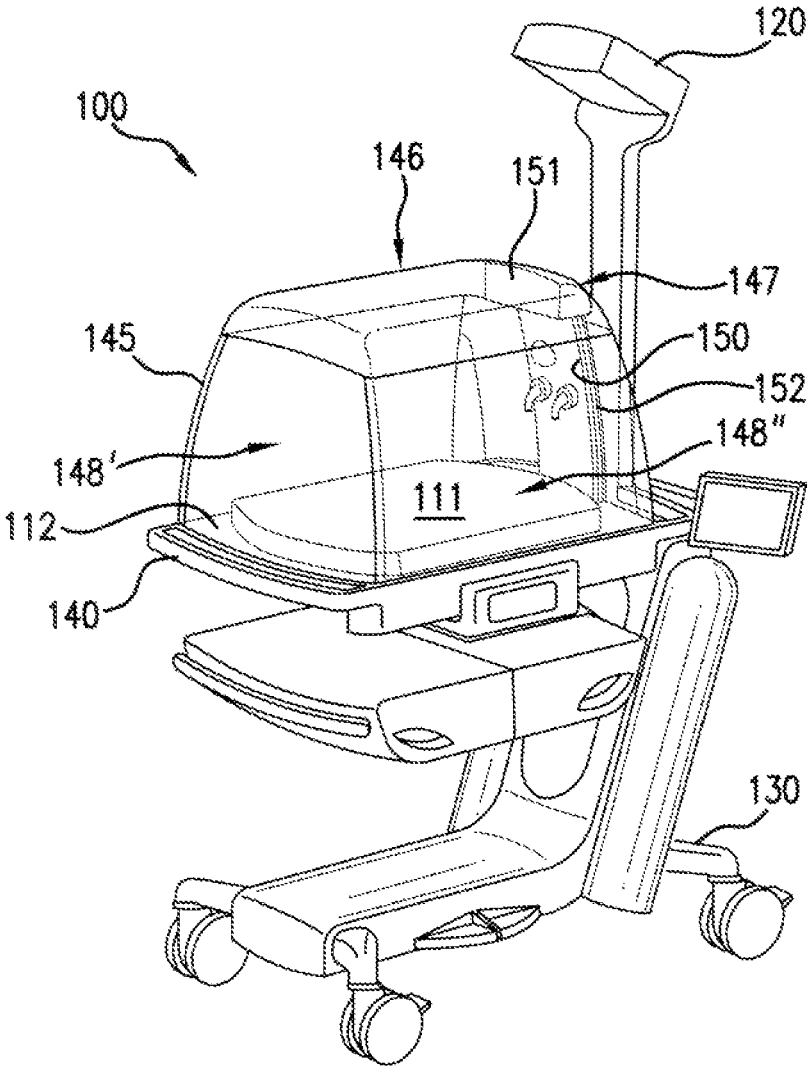
FIG. 3 is a perspective view of a second exemplary embodiment of a warming therapy device.

Referring now to FIGS. 4-7, the exemplary warming therapy device 100 of FIG. 3 is shown having parts of its hood assembly 145 in various other positions, such as prior to or during placement of the infant patient in the warming therapy device 100, or prior to or during removal of the infant patient, for example. Although the exemplary hood assembly 145 is shown having just four sidewalls 148, each configured as a solid panel, it should be understood that a hood assembly in accordance with the present invention may comprise more or fewer sidewalls 148, and that each sidewalls 148 may themselves be divided into multiple segments that may be independently positioned, as further discussed below.

Figure 4:
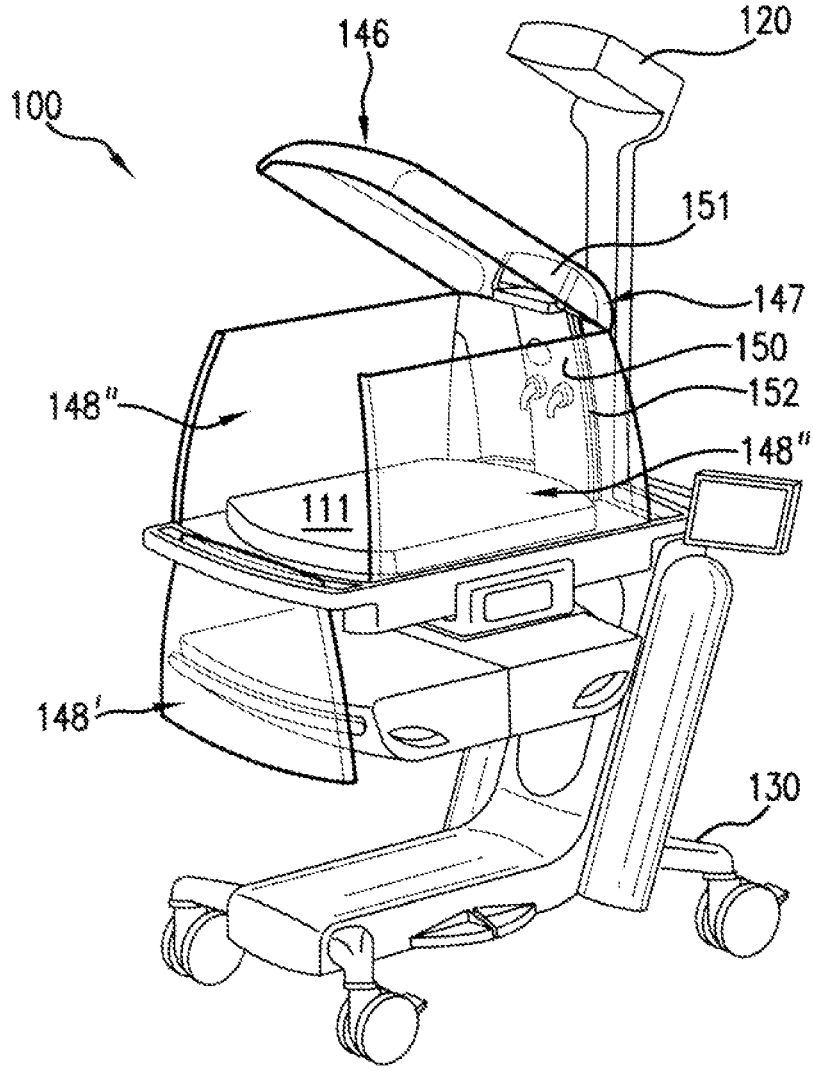
FIG. 4 is a perspective view of the warming therapy device of FIG. 3, shown in a partially open configuration.

FIG. 4 shows the top portion 146 of the hood assembly 145 in a partially opened position, pivoted at approximately forty-five degrees (45°) with respect to the lateral side walls 148". FIG. 4 also shows the front sidewall 148' positioned vertically with respect to the patient support platform 140, so that it is substantially beneath the plane of the support platform 140. As noted above, the movement and positioning of the front side wall 148' may be adjusted via a sliding mechanism, a pivoting mechanism, a rotating mechanism, or any other means known to those of ordinary skill in the art.

FIG. 5 shows the top portion 146 of the hood assembly 145 open, positioned at ninety degrees (90°) with respect to the patient support platform via a sliding mechanism. That is, a protrusion member 151 coupled to the top portion 146 has been engaged and guided along a corresponding guide member 152 until the top portion 146 reaches a position directly behind the rear sidewall 148'''. Although a sliding mechanism has been described in connection with positioning the top portion 146, it should be understood that a pivoting means, a rotating means, and/or any other means known in the art may also be utilized to effectuate the movement and positioning of the top portion 146.

FIG. 5 also shows the left and right side walls 148''' adjusted vertically relative to the patient support platform 140, so that they are both substantially positioned beneath the plane of the support platform 140. The rear side wall 148''' remains in its initial position, as shown in FIG. 3. As with the top portion 146, the adjusting of the side walls 148 may occur via a sliding mechanism, a pivoting mechanism, a rotating mechanism, or any other means known to those of ordinary skill in the art.

When the hood assembly 145 is configured and adjusted as is shown in FIG. 5, an infant patient may be placed on the mattress 111, or removed therefrom, with no obstructions across 270° of lateral axis to the interior of patient support platform 140. Once the infant patient is so placed (or removed), the sidewalls 140 and/or top portion 146 may be adjusted and returned to a closed position (e.g., FIG. 3), or partially closed position (e.g., FIG. 7) to provide treatment and/or access to the infant patient while protecting the infant patient from rolling of the mattress 111.

FIG. 6 shows the warming therapy device 100 as configured in FIG. 5 from overhead. FIG. 6 more clearly illustrates the manner in which the top portion 146 and sidewalls 148 of the hood assembly 145 may be positioned in an open position, thereby exposing the entirety of the mattress tray 112 and mattress 111 without obstructions across at least 270° around the front and sides of the patient support platform 140.

FIG. 7 shows an alternate configuration where the front, right and left sidewalls 148', 148" have been lowered relative to the mattress tray 112 so that only a portion of each of said sidewalls 148', 148" remains above the plane of the mattress tray 112. Such a configuration provides access to an infant patient residing on the mattress 111, while protecting the infant patient from falling off the mattress 111.

Figure 8:
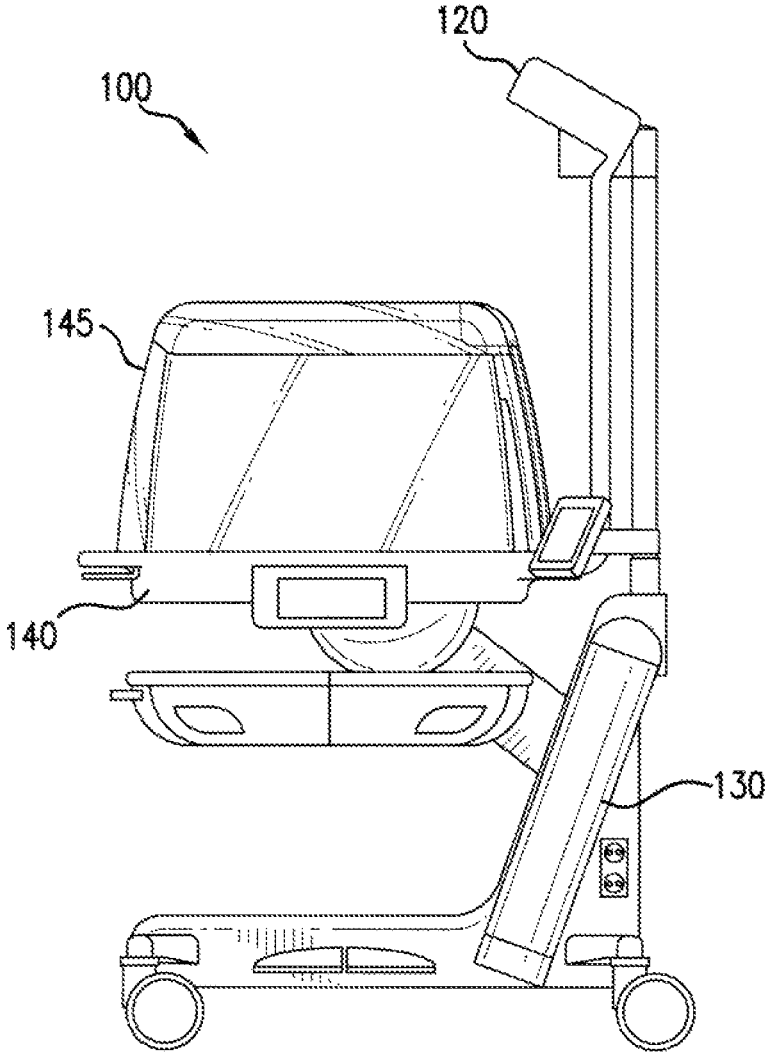
FIG. 8 shows a side view of the warming therapy device of FIG. 3.
Figure 9:
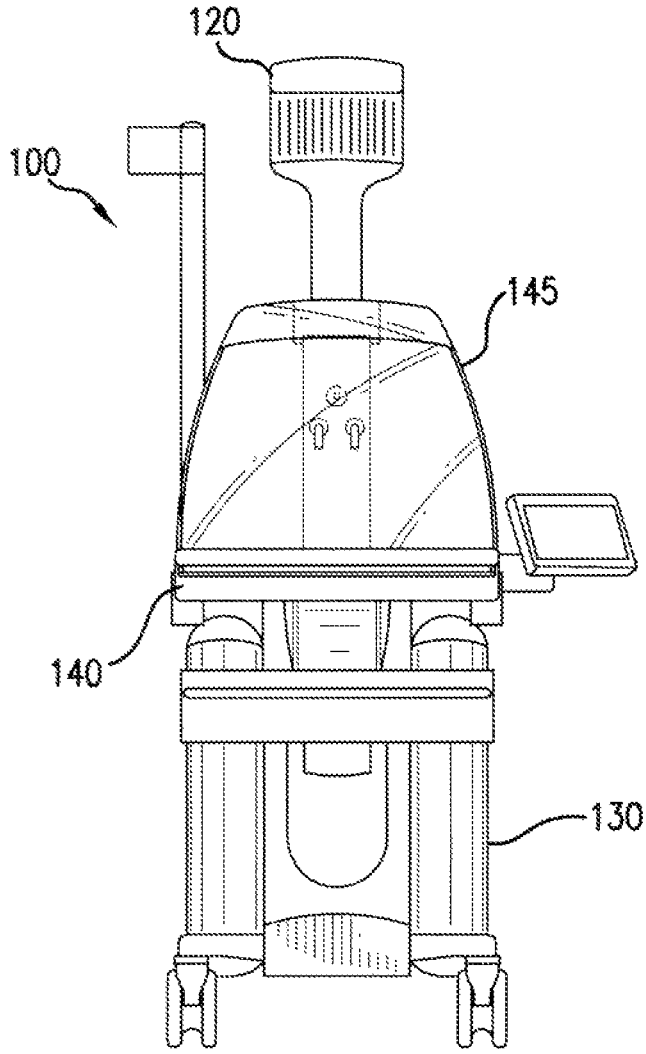
FIG. 9 shows a front view of the warming therapy device of FIG. 3.

FIGS. 8 and 9 show side and front views of the warming therapy device 100, respectively. The warming therapy device 100 includes a radiant heater 120, a transportation assembly 130, a patient support platform 140, and a hood assembly 145.

Referring now to FIGS. 10-16, a warming therapy device 200 according to a third exemplary embodiment of the present invention is shown. Each of FIGS. 10-14 shows the exemplary warming therapy device 200 with its components in various positions.

The warming therapy device 200 includes a radiant heater 220, a transportation assembly 230, a patient support platform 240, and a hood assembly 245. The transportation assembly 230 provides additional support and mobility to the warming therapy device 200, and may include connections to other treatment devices (not shown). The patient support platform 240 may be configured for supporting an infant patient receiving treatment, and it may include a mattress tray 212 with a mattress 211 disposed thereon.

The hood assembly 245 of the exemplary warming therapy device 200 may comprise a retractable top portion 246 and one or more adjustable sidewalls 248. As shown, the hood assembly comprises one or more hinged members 247 for coupling to and pivoting the top portion 246 about the hinged member 247 axis. Also included is a sliding mechanism for retracting and further positioning the top portion 246. The sliding mechanism shown comprises of one or more protrusion members 251 and one or more corresponding guide members 252. The guide members 252 preferably define a track or guide channel, and an opening at one end. These guide members 252 may be coupled to a rear sidewall 248 or to the patient support platform 240, as shown (or in some cases, to the top portion 246). Complementing the guide member(s) 252 are one or more protrusion members 251, each having a protrusion extending therefrom, for engaging a corresponding guide member 252 through a guide channel opening. The protrusion members 251 may be coupled to the top portion 246, to a sidewall 248, and/or to the patient support platform 240 (depending on the location of the guide members 252).

Figure 10:
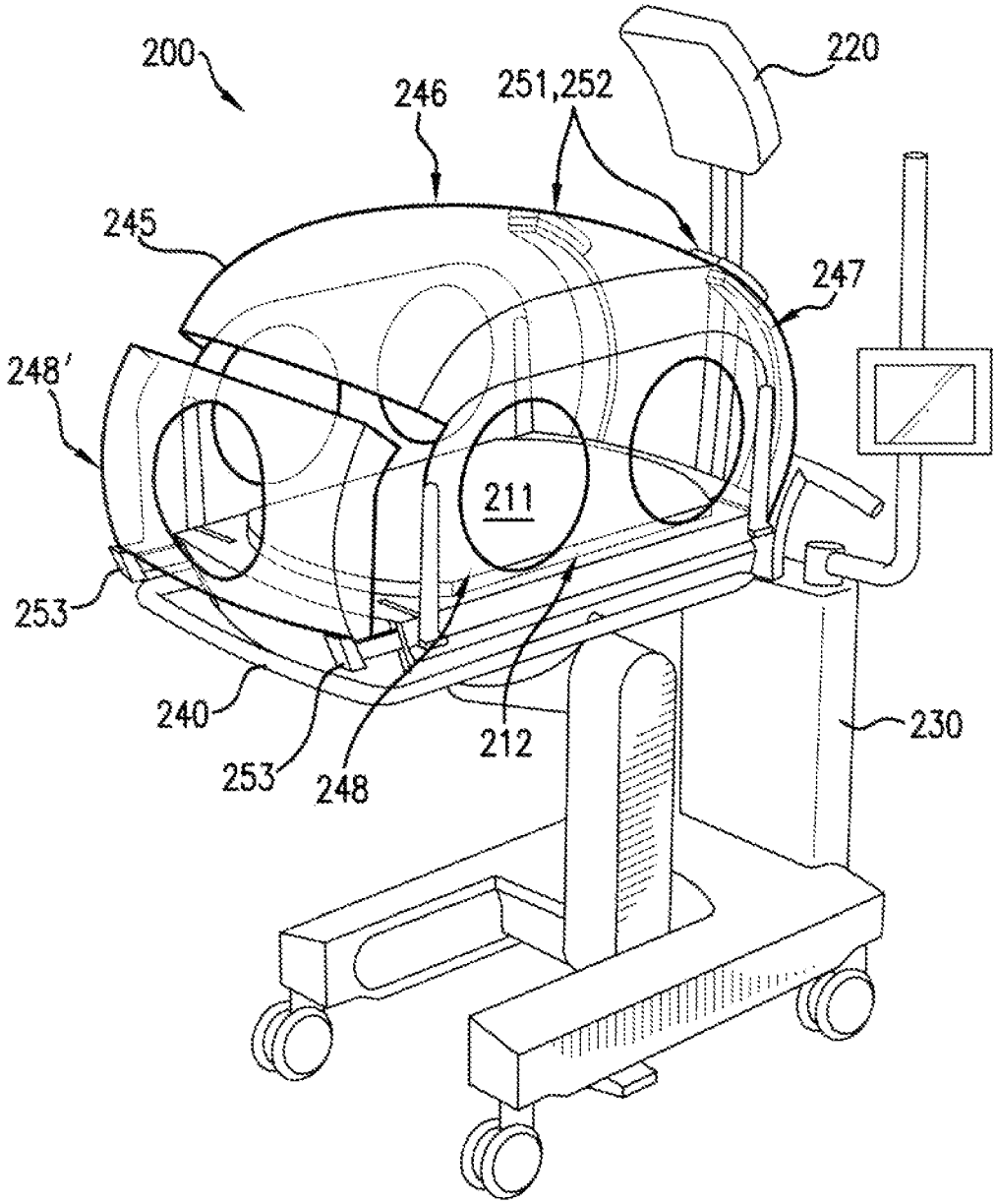
FIG. 10 is perspective view of a third exemplary embodiment of a warming therapy device.
Figure 13:
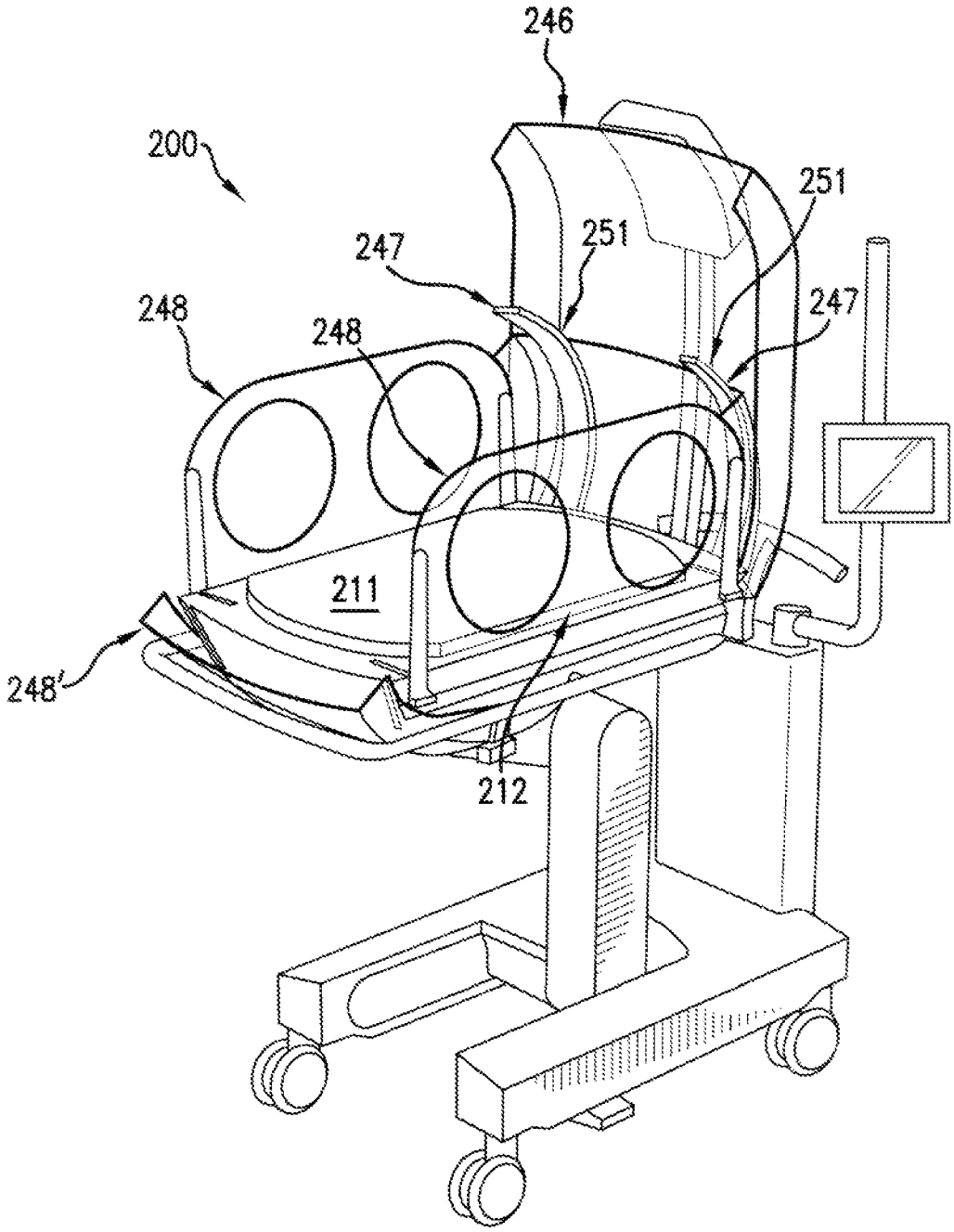
FIG. 13 is a perspective view of the warming therapy device of FIG. 10, shown in a partially open configuration.

The top portion 246 may be retracted and positioned by engaging a protrusion member 251 into a corresponding guide member 252 and then sliding the protrusion member 251 along the guide member's 252 guide channel. Thus, the top portion 246 may be operated between a first, open position (as shown in FIG. 13), a second, closed position (as shown in FIG. 10), or any third position therebetween, by simply sliding the protrusion member 251 along the guide member 252 until a desired position is attained.

The hood assembly 245 may also include one or more sidewalls 248, each configured for independent adjustment relative to the patient support platform 240. The means for adjusting these sidewalls 248 may include one or more of a sliding mechanism (e.g., comprising a guide channel and complementary protrusion), a pivoting mechanism (e.g., a hinged member), a rotating mechanism (e.g., a rotating member), a linkage, such as a four bar linkage, and/or any other mechanism for moving/adjusting the sidewall(s) 248 into a desired position.

A sliding mechanism may include one or more guide members, each defining a guide channel and an opening at one end, coupled to at least one of the sidewalls 248 and/or to the support platform 240. In addition, one or more protrusion members, each having a protrusion extending therefrom, may be provided for engaging a guide channel through a guide channel opening. These protrusion members may be coupled to the patient support platform 240 and/or to sidewall 248. In use, a sidewall 248 may be positioned by engaging a protrusion member (coupled to the sidewall 248, for example) into a corresponding guide member (coupled to the support platform 240 or to another sidewall 248, for example) and then sliding the protrusion member up or down along the guide member's guide channel until a desired position is reached.

Figure 11:
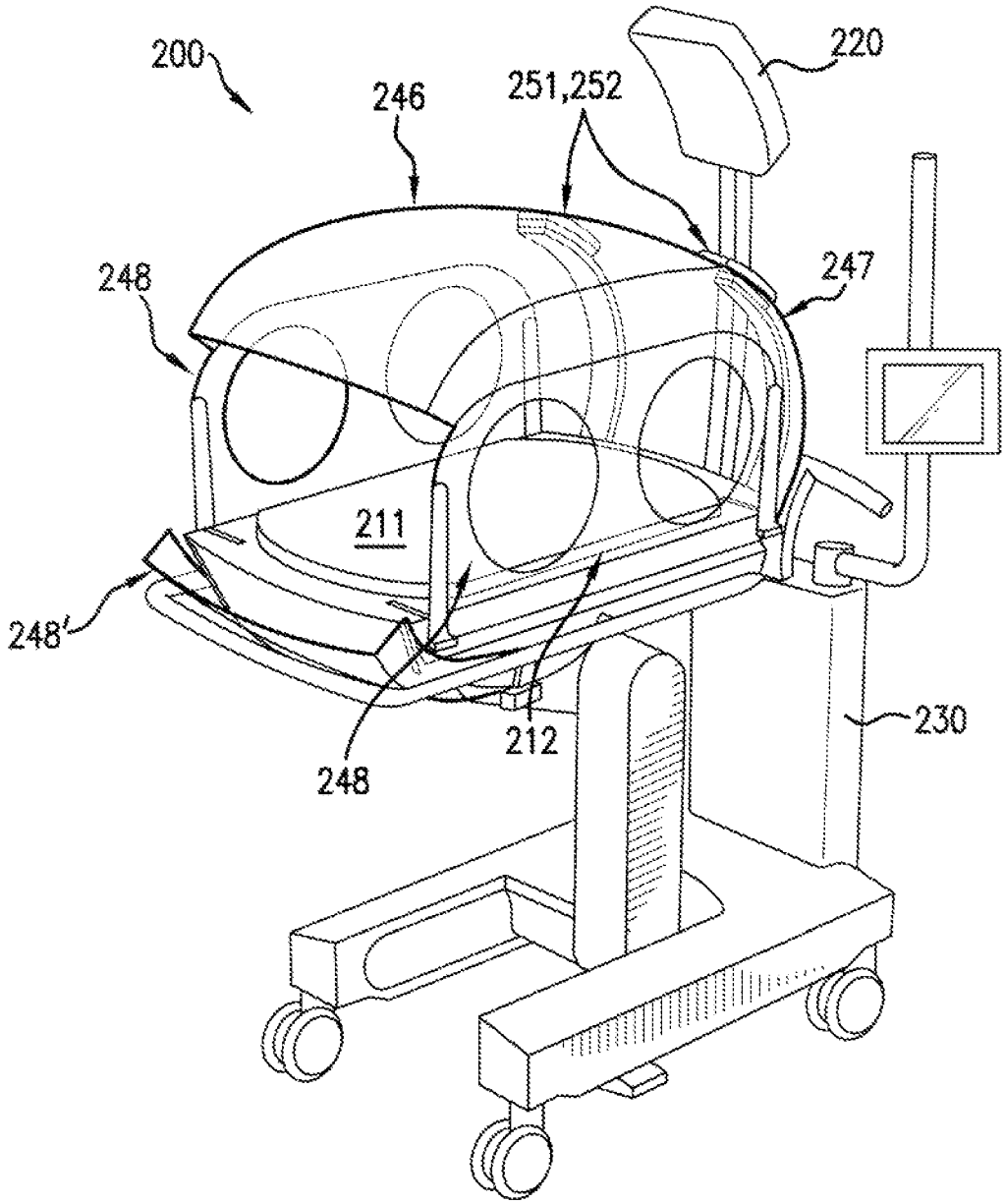
FIG. 11 is a perspective view of the warming therapy device of FIG. 10, shown in a partially open configuration.

A sliding mechanism 253 is provided for adjusting the front sidewall 248', thereby enabling the front sidewall 248' to slide down and horizontally relative to the support platform 240 until the front sidewall 248' is positioned substantially beneath (or in some cases, within) the support platform 240 (as shown in FIG. 11, for example). It should be understood, however, that other mechanisms may be used to adjust and/or position the front sidewall 248, as further discussed below.

Alternatively, one or more of the sidewalls 248 may comprise a pivoting mechanism, which, as discussed above, may include one or more hinged members coupled at one end to a sidewall 248 and at an opposite end to the patient support platform 240 (or to another sidewall 248). In use, a sidewall 248 coupled via a hinged member may be pivoted into any one of a first, open position, a second, closed position, and a third position therebetween.

Alternatively, one or more of the sidewalls 248 may comprise a rotating mechanism. This rotation mechanism may include a rotating member having a first end coupled to a sidewall 248 and a second end coupled to the patient support platform 240 (or to another sidewall 248). In use, the sidewall 248 coupled via the rotating member may be rotated into any one of a first, open position, a second, closed position, and a third position therebetween.

Optionally, the hood assembly 245 described above may also include one or more stop mechanisms (not shown) for temporarily locking the top portion 246 and/or one or more of the sidewalls 248 in a desired position. Each of these stop mechanisms may be a part of the mechanisms used for positioning the top portion 246 and sidewalls 248 (e.g., hinged member, sliding mechanism, etc.), or they may comprise independent components. One or more release mechanisms may also be included to enable the top portion 246 and/or any of the sidewalls 248 to be completely removed from hood assembly 245.

Referring now to FIGS. 11-14, the exemplary warming therapy device 200 of FIG. 10 is shown having parts of its hood assembly 245 in various other positions, such as prior to or during placement of the infant patient in the warming therapy device 200, or prior to or during removal of the infant patient, for example. In particularly, FIGS. 11-14 show a gradual progression of the hood assembly 245, going from a nearly closed position (as in FIG. 11) to a nearby open position (as in FIG. 14), with the exception of one lateral sidewall 248 left partially raised and one rear sidewall left in its original position.

FIG. 11 shows the front sidewall 248' open and positioned within an area provided within the patient support platform 240. As noted above, the adjusting or positioning of the sidewalls 248 (including the front sidewall 248') is not limited to a sliding mechanism. To the contrary, the sidewalls 248 may be adjusted or positioned using a pivoting mechanism, a rotating mechanism, or any other means known to those of ordinary skill in the art.

Figure 12:
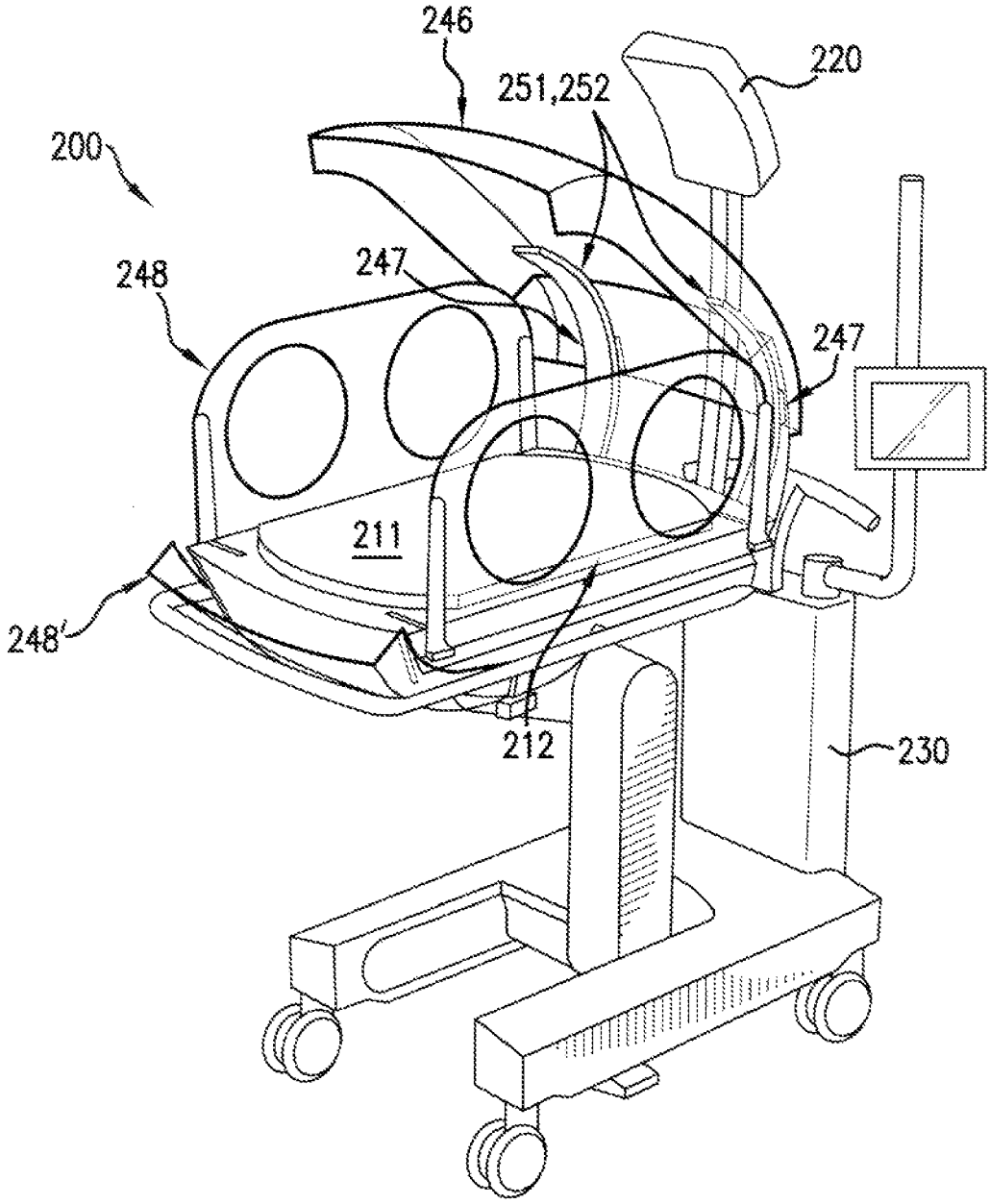
FIG. 12 is a perspective view of the warming therapy device of FIG. 10, shown in a partially open configuration.

FIG. 12 shows the top portion 246 of the hood assembly 245 partially opened, positioned at approximately forty-five degrees (45°) with respect to the right and left sidewalls 248, and slid down via a sliding mechanism 251, 252 towards an area behind the rear sidewall 248. As previously noted, positioning of the top portion 246 is not limited to pivoting and/or sliding. To the contrary, any other means for positioning the top portion 246 including, without limitation, a rotating mechanism or any other means known to those of ordinary skill in the art, may be used in accordance with the present invention.

FIG. 13 shows the top portion 246 of the hood assembly 245 in an open position, a full ninety degrees (90°) relative to the patient support platform 240. In this configuration, the top portion 246 may have, been pivoted (via hinged member 247, for example) and slid along guide members 252 until said top portion 246 became completely situated behind the rear sidewall 248.

Figure 14:
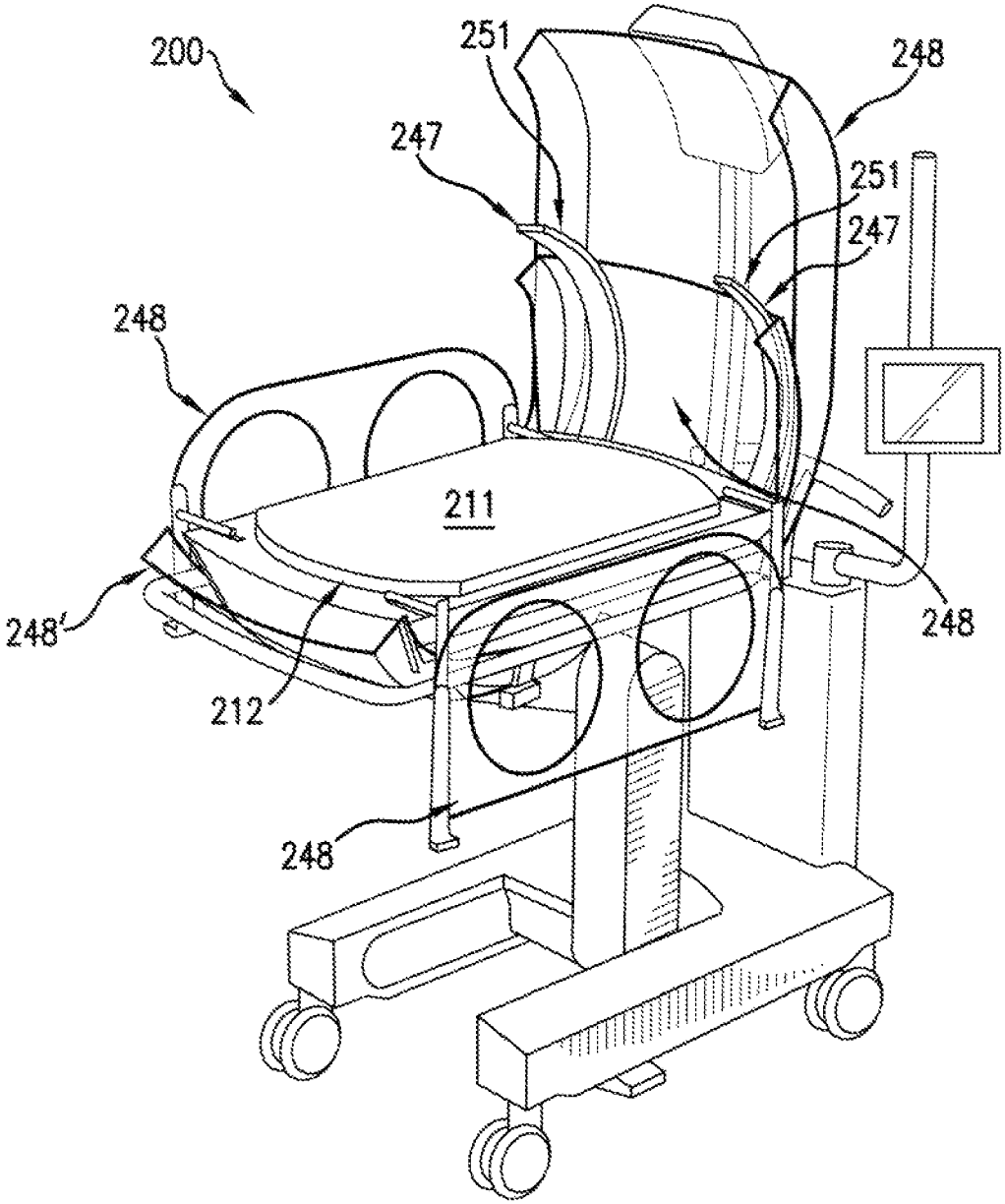
FIG. 14 is a perspective view of the warming therapy device of FIG. 10, shown in an open configuration.

FIG. 14 shows the top portion 246 in a first, open position (as in FIG. 13), as well as a left sidewall 248 positioned substantially entirely beneath the plane of the mattress tray 212, and a portion of a right sidewall 248 positioned partially beneath the plane of the mattress tray 212. The rear sidewall 248 remains in its original position (as shown in FIG. 10). As noted above, the positioning of the right and left sidewalls 248 may be effectuated via a sliding mechanism, a pivoting mechanism, a rotating mechanism, or any other means known to those in the art.

When the hood assembly 245 is configured and adjusted as shown in FIG. 14, an infant patient may be placed on the mattress 211, or removed therefrom, with no obstructions. Once the infant patient is so placed (or removed), the sidewalls 248 and/or top portion 246 may be adjusted and returned to a fully or partially closed position (e.g., FIGS. 10, 12) to provide treatment and/or access to the infant patient while protecting the infant patient from falling off of the mattress 211.

Figure 15:
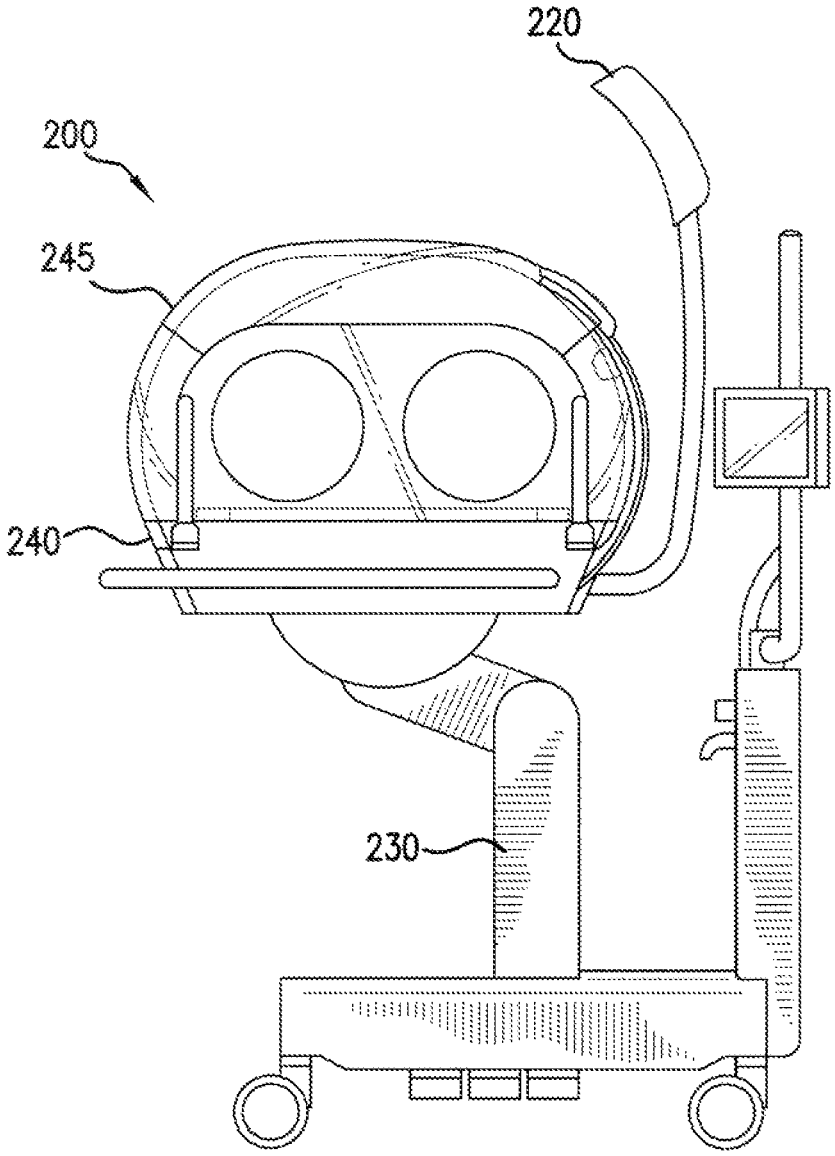
FIG. 15 shows a side view of the warming therapy device of FIG. 10.
Figure 16:
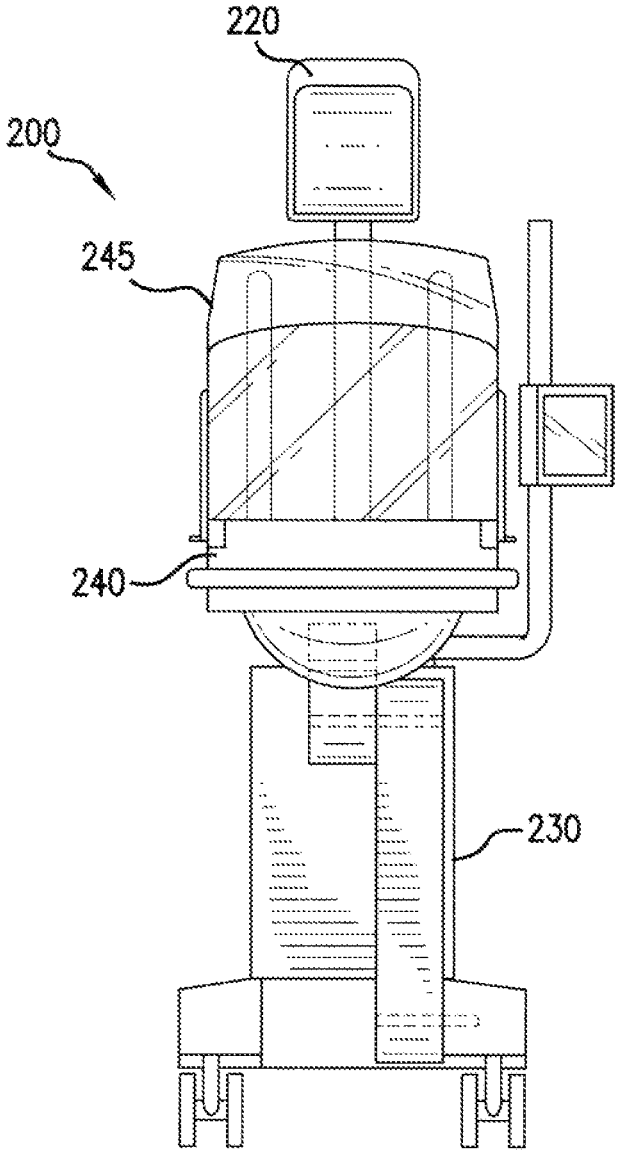
FIG. 16 shows a front view of the warming therapy device of FIG. 10.

FIGS. 15 and 16 show side and front views of the warming therapy device 200, respectively. The warming therapy device 200 includes a radiant heater 220, a transportation assembly 230, a patient support platform 240, and a hood assembly 245.

Figure 17:
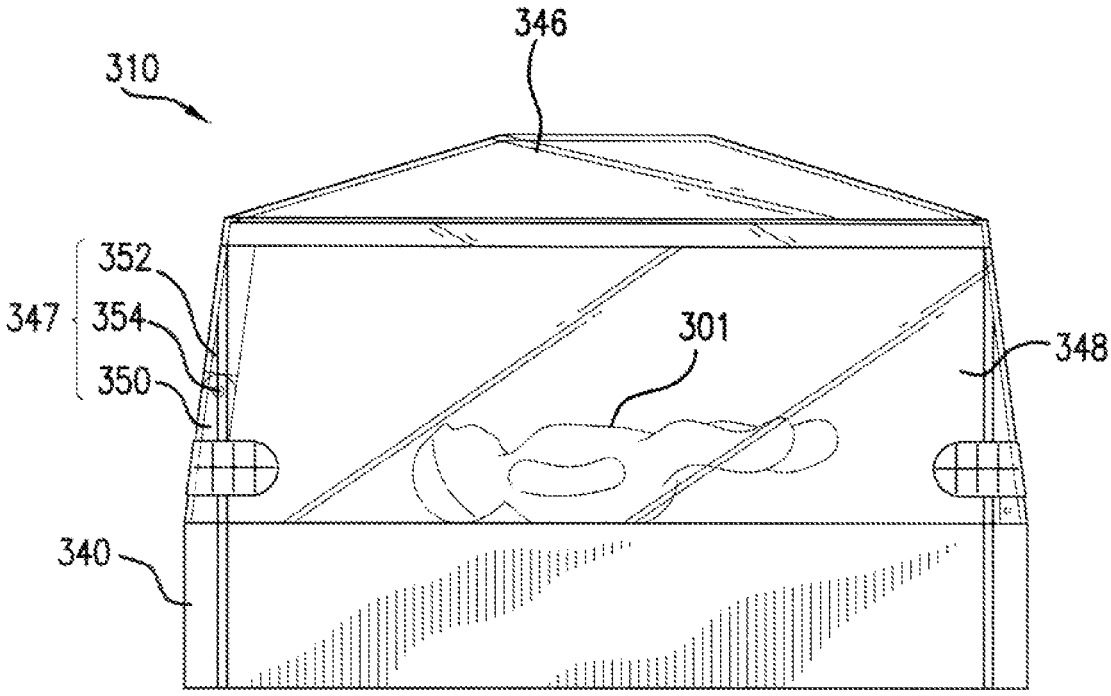
FIG. 17 is a side devotional view of a fourth exemplary embodiment of a warming therapy device.
Figure 18:
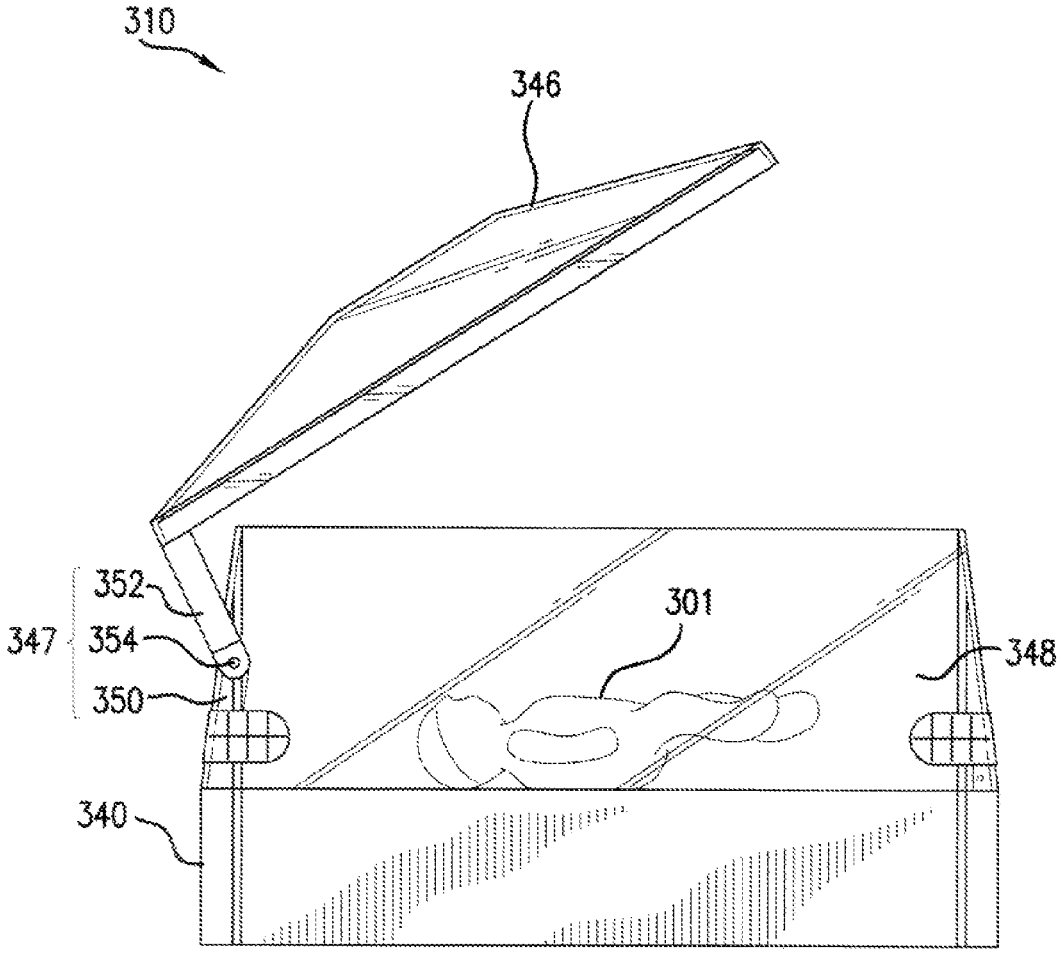
FIG. 18 is a perspective view of the warming therapy device of FIG. 17, shown in a partially open configuration.
Figure 19:
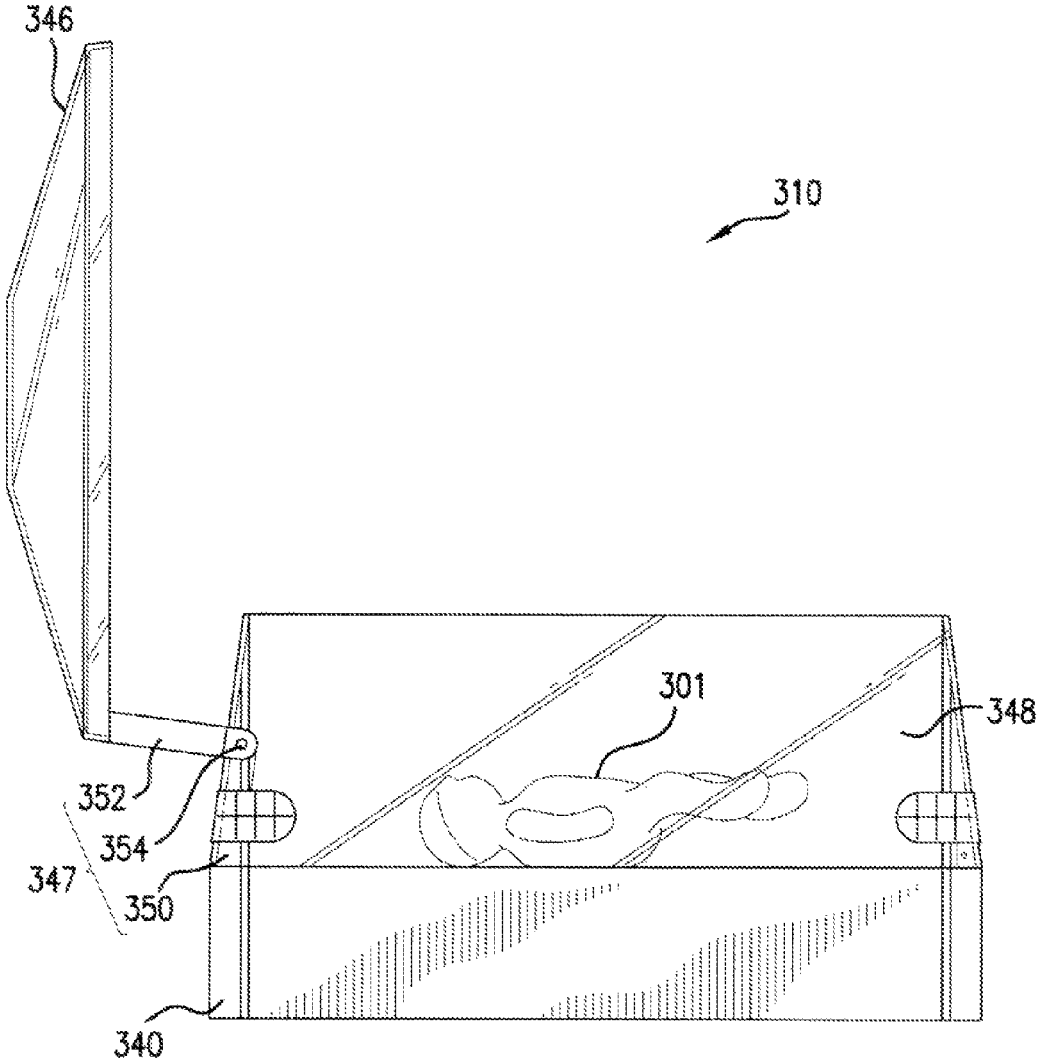
FIG. 19 is a perspective view of the warming therapy device of FIG. 17, shown in a partially open configuration.

Turning now to FIGS. 17-19, a further embodiment of a warming therapy device 310 is shown. The warming therapy device 300 includes a patient support, platform 340 for supporting an infant patient 301 receiving treatment, and a hood assembly that includes one or more sidewalls 348 and a retractable top portion 346. As further discussed below, the retractable top portion 346 may be positioned in a first, open position (FIG. 19), a second, closed position (FIG. 17), or in a third position between closed and open (FIG. 18).

The top portion 346 is adapted to pivot about one or more hinged members 347. Each hinged member 347 in this exemplary embodiment may be coupled at one end to the top portion 346 and at an opposite end to the patient support platform 340, thereby pivotally affixing the top portion 346 to the patient support platform 340. Alternatively, the hinged member(s) 347 may be used to couple the top portion 346 directly to one or more sidewalls 348. As a result of utilizing the hinged member(s) 347, the top portion 346 ma be positioned into any one of a closed position (as shown in FIG. 17), an open position (as shown in FIG. 19), or in a position between closed and open (as shown in FIG. 18). As will be appreciated by those of skill in the art, the ability to retract the hood's top portion 346 (without having to disturb any of the sidewall(s) 348) vastly improves the access a caretaker may have to a patient 301 residing on the support platform 340, without having to compromise the safety provided by the sidewalls 348.

As shown, the top portion 346 is adapted to pivot about one or more hinged members 347. The hinged member 347 has a first member 350 connected to the patient support platform 340 and a second member 352 connected to the top portion 346. The first and second members 350, 352 are connected by a hinge 354, such as a pin, piano hinge or some other member that allows the second member 352 to rotate about a single axis with respect to the first member 350.

The hinge 354 is preferably spaced between the top of the patient support platform 340 and the bottom surface of the top portion 346. Alternatively and not shown in the Figures, the hinge 354 may be located adjacent the patient support platform 340 or adjacent the top portion 346. Depending on the location of the hinge 354, the length of the first and second members 350, 352 will vary. Depending on the configuration of the warming therapy device 310, it may be desirable to move the hinge 354 closer to either of the top portion 346 or the partial support platform 340. For example, in a configuration where a radiant heater (not shown in FIGS. 17-19) is spaced back away from the patient support platform 340, or if the height of the radiant heater is not great, it may be desirable to have the hinge 354 placed closer to the patient support platform 340, such that the height of the top portion 346 in the open position is minimized and so that the top portion 346 does not obstruct the path between the radiant heater and the patient support platform 340 because the top member 346 is spaced away from the patient support platform 340 in the open position. This spacing is due to the second member 352 being longer than the first member 350 when the hinge 354 is close to the patient support platform 340. Conversely, if lateral space is an issue or if the radiant heater is positioned away from the hinged member 347, it may be desirable to position the hinge 354 closer to the top portion 346, such that the first member 350 is longer than the second member 352 and the top portion 346 is not spaced from the patient support platform 340 when in the open position.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

What is claimed:

1. An apparatus comprising:

a support platform; and a hood assembly for covering a portion of the support platform, said hood assembly comprising a retractable top portion, two or more adjustable sidewalls, and means for positioning the top portion relative to the support platform, wherein the means for positioning said top portion comprises:

a first member coupled to the support platform, said first member defining a guide channel and an opening at one end; and a second member coupled to the top portion, said second member having a protrusion extending therefrom for engaging the guide channel through said opening, said first member being pivotable relative to the support platform and said protrusion being movable relative to the first member along said guide channel, wherein moving said protrusion along the guide channel positions the top portion in any one of a first position, a second position, and a third position between said first and second positions.

2. The apparatus of claim 1, further comprising means for adjusting one or more of the two or more adjustable sidewalls relative to said support platform.

3. The apparatus of claim 1, wherein the first member is coupled to the top portion and the second member is coupled to the support platform.

4. The apparatus of claim 1, wherein the means for positioning said top portion includes one or more stop mechanisms for temporarily locking said top portion in at least one of a first position, a second position, and a third position between said first and second positions.

5. The apparatus of claim 1, further comprising a release mechanism for disengaging the top portion from the hood assembly, thereby enabling said top portion to be completely separated from the apparatus.

6. The apparatus of claim 2, wherein said means for adjusting is adapted for raising and lowering said one or more of the two or more adjustable sidewalls relative to the support platform, thereby positioning said one or more sidewalls in one of a first position, a second position, and a third position between said first and second positions.

7. The apparatus of claim 2, wherein said means for adjusting comprises a hinged member having a first end coupled to said one or more of the two or more adjustable sidewalls and a second end coupled to the support platform, said hinged member pivotally affixing said one or more sidewalls to the support platform such that said one or more sidewalls may be pivoted into a first position, a second position, and a third position between said first and second positions relative to the support platform.

8. The apparatus of claim 2, wherein said means for adjusting comprises a rotating member having a first end coupled to said one or more of the two or more adjustable sidewalls and a second end coupled to the support platform, said rotating member rotatably affixing said one or more sidewalls to the support platform such that said one or more sidewalls may be rotated into a first position, a second position, and a third position between said first and second positions relative to the support platform.

9. The apparatus of claim 1, wherein at least one of said two or more adjustable sidewalls is removable from the hood assembly.

10. An apparatus comprising:

a support platform, a hood assembly for covering a portion of the support platform, said hood assembly comprising a retractable top portion, two or more adjustable sidewalls, and means for positioning the top portion relative to the support platform; and means for adjusting one or more of the two or more sidewalls relative to said support platform, wherein said means for adjusting comprises:

one or more guide members coupled to said one or more of the two or more adjustable sidewalls, said guide members each defining a guide channel and an opening at one end; and one or more protrusion members coupled to the support platform, said protrusion members each having a protrusion extending therefrom for engaging a guide channel through the opening, each of said one or more guide members being movable relative to the protrusion along the guide channel, wherein moving said one or more guide members along its guide channel relative to the protrusion positions said one or more sidewalls in any one of a first position, a second position, and a third position between said first and second positions.

11. A hood assembly comprising:

a retractable top portion;

two or more adjustable sidewalls;

means for positioning the retractable top portion relative to the hood assembly; and means for adjusting one or more of the two or more sidewalls, wherein the means for adjusting the one or more sidewalls comprises at least one of:

a pivoting means pivotally affixing said one or more of the two or more adjustable sidewalls to the hood assembly for pivoting said one or more sidewalls relative to the hood assembly into any one of a closed position, an open position, and a position between said closed and open positions;

a guide means affixing said one or more of the two or more adjustable sidewalls to the hood assembly in a guided engagement for raising and lowering said one or more sidewalls relative to the hood assembly, thereby positioning said one or more sidewalls in any one of a first position, a second position, and a third position between said first and second positions; and a rotating means rotatably affixing said one or more of the two or more adjustable sidewalls to the hood assembly for rotating said one or more sidewalls relative to the hood assembly into any one of a first position, a second position, and a third position between said first and second positions.

12. The hood assembly of claim 11, wherein the means for positioning said top portion includes one or more stop mechanisms for temporarily locking said top portion in at least one of a first position, a second position, and a third position between said first and second positions.

13. The hood assembly of claim 11, further comprising a release mechanism for disengaging the top portion from the hood assembly, thereby enabling said top portion to be completely separated from said one or more of the two or more adjustable sidewalls.

14. A mobile warming therapy device for patients, said warming therapy device comprising:

a transportation assembly;

a patient support platform coupled to the transportation assembly for supporting a patient;

a heating unit for radiating heat onto the patient support platform; and a hood assembly for covering the patient residing on the patient support platform, said hood assembly comprising a retractable top portion, said hood assembly comprising a first member coupled to the patient support platform, said first member defining a guide channel and an opening at one end, and a second member coupled to the retractable top portion, said second member having a protrusion extending therefrom for engaging the guide channel through said opening, wherein said first member is pivotable relative to the patient support platform, wherein said protrusion is movable relative to the first member along said guide channel, and wherein moving said protrusion along the guide channel positions the retractable top portion in any one of a first position, a second position, and a third position between said first and second positions.

15. A warming therapy device comprising:

a support platform;

a hood assembly for covering a portion of the support platform, said hood assembly comprising an adjustable top portion, and two or more adjustable sidewalls, and a sliding mechanism for moving the adjustable top portion with respect to the support platform, said sliding mechanism comprising a first member coupled to the support platform, said first member defining a guide channel and an opening at one end, and a second member coupled to the adjustable top portion, said second member having a protrusion extending therefrom for engaging the guide channel through said opening, wherein said first member is pivotable relative to the support platform, and wherein said protrusion is movable relative to the first member along said guide channel, wherein the adjustable top portion is adapted to move between a first position, where the adjustable top portion is substantially parallel to the support platform, and a second position, where the adjustable top portion is substantially perpendicular to the support platform, wherein the adjustable top portion is adapted to move between a first position, where the adjustable top portion is substantially parallel to the support platform, and a second position, where the adjustable top portion is substantially perpendicular to the support platform.

* * * * *